United States Patent [19]

McCrocklin et al.

[11] 4,258,650

[45] Mar. 31, 1981

[54] ROD HOLDER FOR COATING DOCTOR SYSTEM

[76] Inventors: Teddy A. McCrocklin, 3511 Forsythe Ave., Monroe, 71201; Carl E. McMillan, 203 Elmwood; William M. Newman, Sr., 2000 Star Dr., both of West Monroe, La. 71291

[21] Appl. No.: 77,238

[22] Filed: Sep. 19, 1979

[51] Int. Cl.[3] ..... B05C 11/02

[52] U.S. Cl. ..... 118/101; 118/104; 118/118

[58] Field of Search ..... 118/101, 104, 116, 117, 118/118, 119, 203; 427/361, 364; 15/256.5; 101/363

[56] References Cited

U.S. PATENT DOCUMENTS

| | | | |
|---|---|---|---|
| 3,418,970 | 12/1968 | Phelps et al. | 118/413 X |
| 3,701,335 | 10/1972 | Barnscheidt | 118/104 |
| 3,817,208 | 6/1974 | Barnscheidt et al. | 118/119 |
| 4,128,077 | 12/1978 | Meier | 118/104 |

*Primary Examiner*—John P. McIntosh

*Attorney, Agent, or Firm*—Robert M. Krone; Joseph J. Kelly; Norvell E. Von Behren

[57] ABSTRACT

An improved elongated coating rod holder for a coating doctor apparatus wherein the rod holder has formed therein an elongated cavity for receiving the coating rod with the cavity comprising at least two sealing surfaces therein. The coating rod holder also has formed therein a cooling water chamber formed as a plurality of smaller chambers having an interconnecting passageway between adjacent chambers. The cooling water chamber is formed directly below the elongated cavity which is connected to at least one cooling water inlet and at least one cooling water outlet formed in the rod holder. The elongated cavity and the cooling water chamber are formed in-line with the axis of rotation of the coating rod so that a pressure exerted on the coating rod during a coating operation will be transmitted downwardly through the coating rod and outwardly to act to seal the rod member against the sealing surfaces of the elongated cavity thereby preventing leakage of water from the water chamber to the exterior of the rod holder.

2 Claims, 9 Drawing Figures

ROD HOLDER FOR COATING DOCTOR SYSTEM

BACKGROUND OF THE INVENTION

This invention relates generally to rod holders for coating doctors and more particularly to a new and novel design of a rod holder having a novel cooling water chamber formed beneath the rod.

In the design and use of polyethylene rod holders, it is known that the life of such holders is very short. The short life results from design features of the various holders and in particular the material used in the construction of the holder. Because of the complicated mountings utilized on prior art holders, excessive changeout time is required whenever it is desirous of changing either the holder or the rod.

A known prior art design utilizes a rod encapsulated in a polyethylene holder with only a small surface of the rod sticking out of the holder. Cooling water is fed into the ends of the rod holder with the inner part of the vein being closed by the rod. The flow of cooling water is then in one end of the holder and out of the other end. Because of the shallowness of the vein depth and as a result of the distance across the paper machine on which the coating doctor is used exceeds the length of 14', high pressures are required to maintain water flow through the holder. It follows naturally that as a result of the high pressures, leakage is experienced in the doctoring portion of the rod. A reduction in the pressure may result in the vein becoming plugged and the increased friction between the rod and the paper web may ruin the polyethylene holder.

One of the problems inherent in the before mentioned prior art holder was the material being used to construct the holder which would not tolerate heat in the range to which it was subjected and further the position of the veins weakened the overall structure of the holder. A further problem resulted in the position in which the veins were cut making it difficult to prevent leakage. A wrap around design which was utilized made it difficult to change out the rods and the metal support holder. The holder was attached to the polyethylene holder by a complicated dove-tailed design. Further problems were experienced since the vein depth restricted the volume of water that could be put through the holder for cooling, cleaning and lubrication and the distance that the water was being forced through the holder interior resulted in high pressures being required.

By referring to FIGS. 1 and 2 of the drawings there can be seen illustrations of a typical prior art rod holder and more specifically showing the interior construction of the cooling water channels. FIG. 1 is a broken perspective view of a typical prior art rod holder while FIG. 2 is a sectional view along line 2—2 of FIG. 1 showing the interior construction of the rod holder and in particular the configuration of the water cooling channels. The rod 10 is positioned within the rod holder 12 as shown in FIGS. 1 and 2 with a dove-tailed slot 14 being utilized for disconnecting the rod holder 12 from the supporting structure which is not shown in the drawing.

By referring to FIG. 2 of the drawing it can be seen that a plurality of water cooling channels 16 and 18 are formed on either side of a wearing surface 20 upon which the cylindrical rod 10 rides during the coating operation. In operation cooling water is circulated through the water cooling channels 16 and 18 by means of a cooling water inlet 22 and is removed from the rod holder by means of the cooling water outlet 24. The cooling water inlet 22 and the cooling water outlet 24 are internally connected to the water cooling channels 16 and 18 by means well known in the art and are not detailed in the prior art views FIGS. 1 and 2 for purposes of clarity.

It can be seen by referring again to FIG. 2 of the drawings that whenever the rod 10 is utilized in the coating operation against a paper web 26 positioned against a backup roll 28, that a downward force will be exerted on the wearing surface 20. The downward force is shown by the arrow 30 and results in extreme wear occurring on the wearing surface 20 and also results in water leakage occurring at the side surfaces 32 and 34 whenever excessive wear occurs on the wearing surface 20.

Another problem utilizing the prior art rod holders shown in FIGS. 1 and 2 occurred whenever sufficient water was attempted to be forced into the holder through the cooling water inlet 22. Because of the internal design of the water cooling channels 16 and 18, it was difficult to carry the cooling water the necessary 14' across the length of the rod holder. Multiple inlets and outlets were attempted and the water cooling channels 16 and 18 were deepened in order to attempt to minimize the problem but without any satisfactory results.

Another problem occurred with the prior art type holder shown in FIGS. 1 and 2 in that the rod 10 had to be inserted through the end 36 of the rod holder 12 because the rod 10 was designed to be positioned below the center points of the rod within the holder at the surfaces 32 and 34 as shown in FIG. 2 of the drawing. This problem also resulted in longer change-out times being required in withdrawing a worn rod 10 from the rod holder 12 by withdrawing it out the end 36 of the rod holder.

A pre-examination search of the Applicants' new and novel improved rod holder resulted in several patents being uncovered which show various configurations of rod holders but are not felt by the Applicant to be especially pertinent to his invention. The prior art type rod holder previously alluded to in the specification and shown in FIGS. 1 and 2 of the Applicants' drawing are typified by the U.S. Pat. No. 3,817,208, issued to Wolfgang Barnscheidt et al on June 18, 1974. This patent utilizes a rod holder which includes a body of elastomeric polyurethane and longitudinal grooves 7 and 8 for carrying, cleaning and lubricating liquid, such as water. The holder has a mounting portion 2 and a rib 3 which is received in a groove a the member 5. A modification of this type prior art rod holder is shown in the U.S. Pat. No. 3,701,335, issued to Wolfgang Barnscheidt on Oct. 31, 1972 wherein there is shown a rod 3 which is rotatably embedded in a confined body of elastomeric polyurethane or synthetic rubber. Lubricant and cooling fluid is fed by means of the conduit 7 to axial grooves 10 which are positioned on the side of the axial line of pressure from the rod coater with the fluid being discharged beyond the sides of the apparatus.

Several patents uncovered in the prior art search disclosed rod coaters wherein non-cooling channels were formed for purposes different than the Applicants' invention and these are typified in the U.S. Pat. No. 3,304,910, issued to E. Warner on Feb. 21, 1967; the U.S. Pat. No. 2, 774,329, issued to R. V. Smith on Dec.

18, 1956; the U.S. Pat. No. 3,271,187, issued to R. J. Chen et al on Sept. 6, 1966 and the U.S. Pat. No. 3,387,585, issued to J. J. Farrell on June 11, 1968.

In addition to the above patents, several patents were uncovered in the search wherein no cooling water channel was formed below the doctor rod and these are typified by the U.S. Pat. No. 3,785,340, issued to Larry O. Stafford et al on Jan. 15, 1974; the U.S. Pat. No. 3,029,779, issued to L. Hornbostel on Apr. 17, 1962; the U.S. Pat. No. 2,334,102, issued to T. A. Kauppi et al on Nov. 9, 1943 and the U.S. Pat. No. 2,695,004, issued to W. J. Montgomery et al on Nov. 23, 1954. The remaining patent uncovered in the prior art search disclosed a doctor system suction apparatus which was mountable along a doctor blade to provide an inlet for removing debris from the surface of the doctor blade and is shown in the U.S. Pat. No. 3,526,017, issued to W. Kleimola on Sept. 1, 1970.

SUMMARY OF THE INVENTION

In order to overcome the problems inherent in the prior art devices described and shown in the cited patents, there has been provided by the Applicants' invention a new and improved coating doctor rod holder which has formed therein at least one cooling water chamber which is formed axially beneath the rod member and forms two sealing surfaces positioned one on each side of the water chamber. The sealing surfaces and the formation of the water chamber directly below the rod operates to allow pressures that are exerted on the rod during the coating operation to be transmitted downwardly and outwardly against the sealing surfaces to seal the rod member against the sealing surfaces thereby preventing leakage of water from the water chamber to the exterior of the chamber. A further improvement in the rod holder allows the entire doctor blade assembly to be quickly disconnected from its supporting member resulting in less down time for change-outs of either the rod holder or the rod.

Accordingly it is an object and advantage of the invention to provide an improved rod holder which minimizes leakage from the rod and utilizes the pressure exerted against the rod to tightly seal water pressure contained within the holder from leakage to the exterior of the holder.

Another object and advantage of the invention is to provide an improved rod holder wherein improved water flow is able to be obtained throughout the length of the holder.

Still yet another object and advantage of the invention is to provide an improved rod holder which may be quickly disconnected from its supporting member resulting in short down times.

These and other objects and advantages of the invention will become apparent from a review of the drawings and from a study of the specification detailing the preferred embodiment of the invention.

DESCRIPTION OF THE PREFERRED EMBODIMENT

Figure 3:
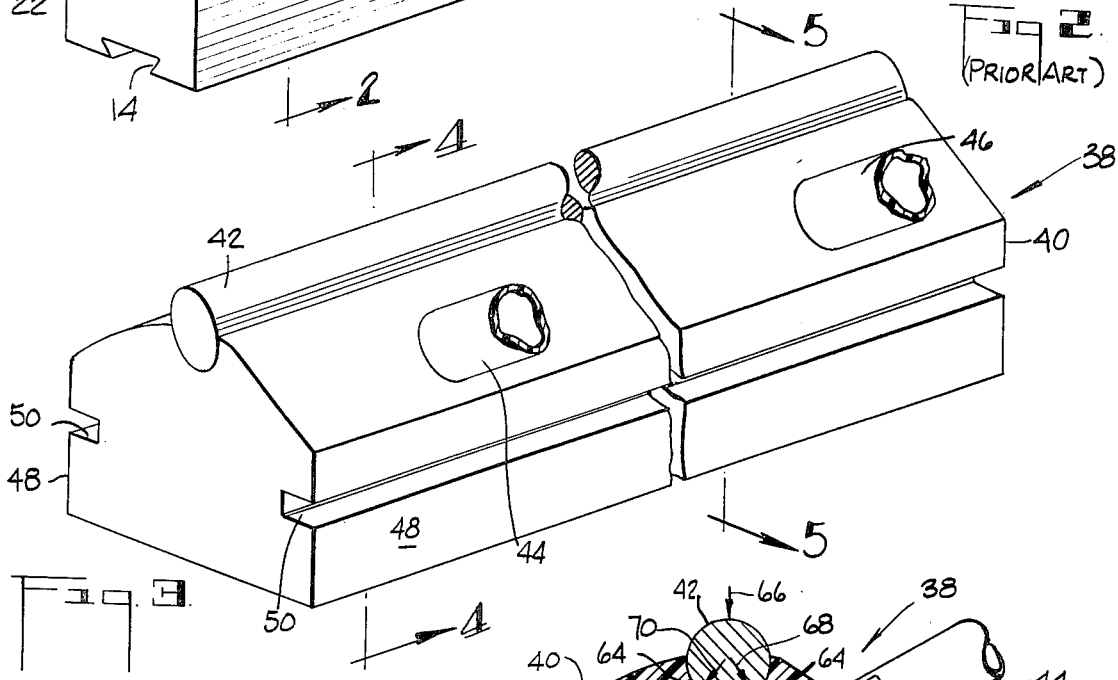
FIG. 3 is a broken perspective view of the Applicants' new and improved rod holder.
Figure 4:
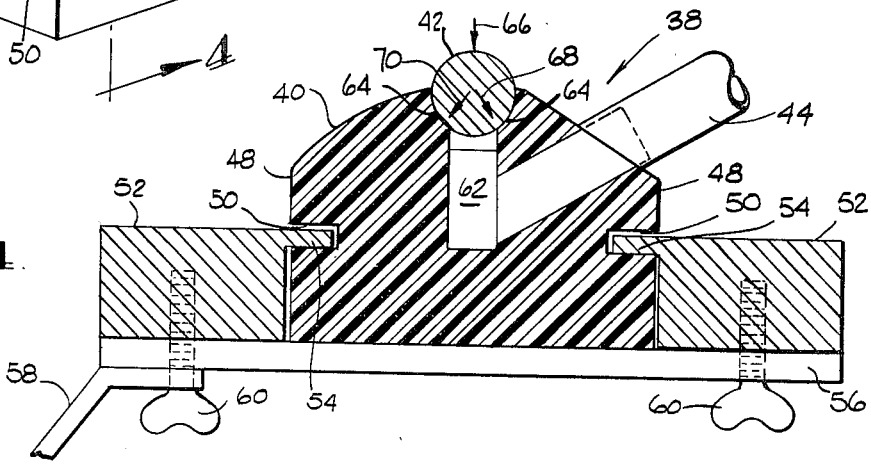
FIG. 4 is a sectional view, taken along line 4—4 of FIG. 3 showing the interior of the Applicants' new and improved rod holder and also showing the quick disconnect features of the preferred embodiment of the rod holder.
Figure 5:
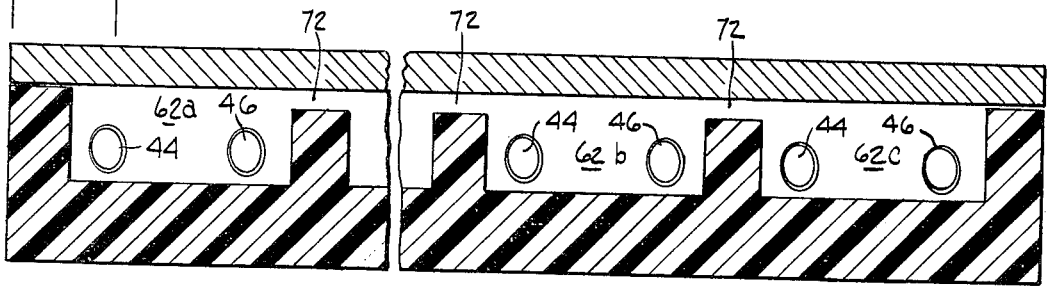
FIG. 5 is a sectional view, taken along line 5—5 of FIG. 3, showing the interior water cooling chamber of the Applicants' new and improved rod holder.

Referring now to the drawings in general and in particular to FIGS. 3, 4 and 5 of the drawing, there is shown the Applicants' new and novel rod holder for a coating doctor system which is shown generally by the numeral 38 and comprises a rod holder 40 for holding a rod 42 as shown in FIG. 3 of the drawings. The rod holder 40 contains a plurality of cooling water inlets 44 and a plurality of cooling water outlets 46. Along the length of the rod holder 40 would be positioned the plurality of inlets 44 and outlets 46 as shown best in FIG. 5 of the drawing. The rod holder 40 would be formed of a heat resistant material such as the material known as "Delrin" which is a polymerized formaldehyde which acts to prevent burning of the ends of the rod holder when in service. With the use of a material such as the heat resistant "Delrin", the Applicants' holder is able to withstand 100% higher temperatures than a normal polyethylene holder which will withstand temperatures of up to 150° F. By the use of the heat resistant material before mentioned, the Applicants' holder is able to withstand temperatures up to 300° F. and longer service life is obtainable over a normal polyethylene holder. For example, with the Applicants' holder seat wear takes approximately six months as compared to a one month seat wear cycle using polyethylene rod holders.

Longitudinally positioned in the sides 48 of the rod holder 40 are a pair of elongated slots 50 which are utilized for quickly disconnecting the rod holder from its supporting member. The quick disconnection is shown in FIG. 4 of the drawing and comprises in part at least two retainers 52 having protruding portions 54 designed to engage in the elongated slots 50 with the retainer 52 being positioned against a plate 56 which is carried by the supporting member 58. The retainers 52 are removably attached to the supporting member 58 on one side of the rod holder 40 and are removably attached to the plate 56 on the other side of the rod holder 40 as shown in FIG. 4 of the drawing.

The removable attachment comprises a plurality of bolts 60 which allow the retainers 52 to be quickly disconnected from the plate 56 and the supporting member 58 so that the rod holder 40 may be quickly removed.

Referring again to FIGS. 4 and 5 of the drawing there can be seen the cooling water chamber 62 which is positioned in line with the axis of rotation of the rod member 42 and axially beneath the rod member 42 to form at least two sealing surfaces 64 which are positioned on either side of the cooling water chamber 62 and carry the rod member 42 as it rotates during the coating cycle. By the use of the positioned sealing surfaces 64 it can be seen that whenever a pressure is applied to the rod member 42 as shown by the arrow 66, that pressure will be distributed to the two sealing surfaces 64 as shown by the arrow 68 and the arrow 70. The pressure thusly exerted is transmitted downwardly through the rod member 42 and outwardly to act to seal the rod member 42 against the sealing surfaces 64 to thereby prevent leakage of water from the cooling water chamber 62 to the exterior of the water chamber.

Figure 1:
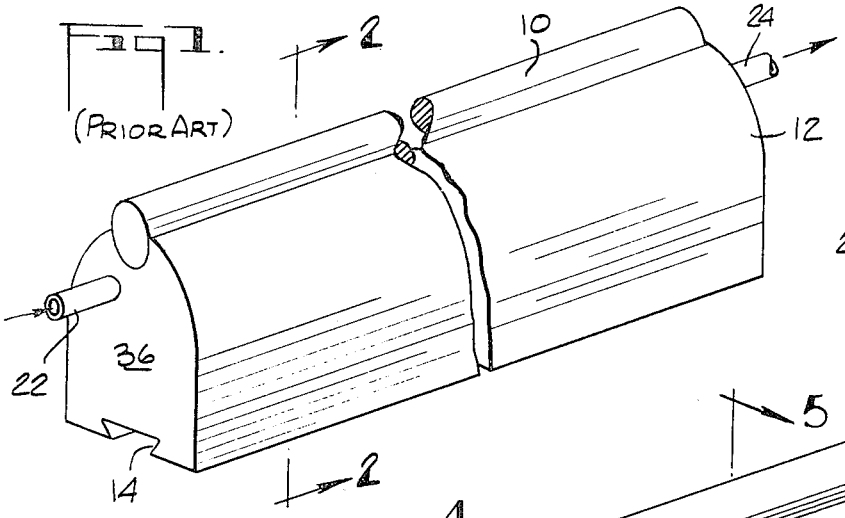
FIG. 1. (PRIOR ART)
FIG. 1 is a broken perspective view of a prior art doctor blade assembly of the type herein before described.
Figure 2:
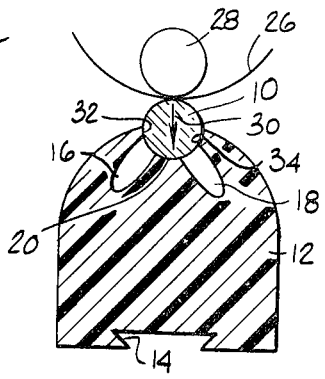
FIG. 2. (PRIOR ART)
FIG. 2 is a sectional view, taken along line 2—2 of FIG. 1 showing a prior art rod holder in position against a paper web.

By referring at this time back to the FIG. 2 prior art drawing and comparing it with the FIG. 4 drawing of the Applicants' invention it can be seen that in the prior art rod holder of FIG. 2 the pressure shown by the arrow 30 was transmitted directly to the wearing surface 20 and water was able to escape from the water cooling channel 16 and 18 past the surfaces 32 and 34 to the atmosphere. In distinction it can be seen in the Applicants' invention as shown in FIG. 4 of the drawing, that a downward force 66 acting on the rod member 42 acts to seal the rod member against the sealing surfaces 64 and to completely retain water in the cooling waters chamber 62 thus minimizing leakage from the cooling water chamber.

Figure 8:
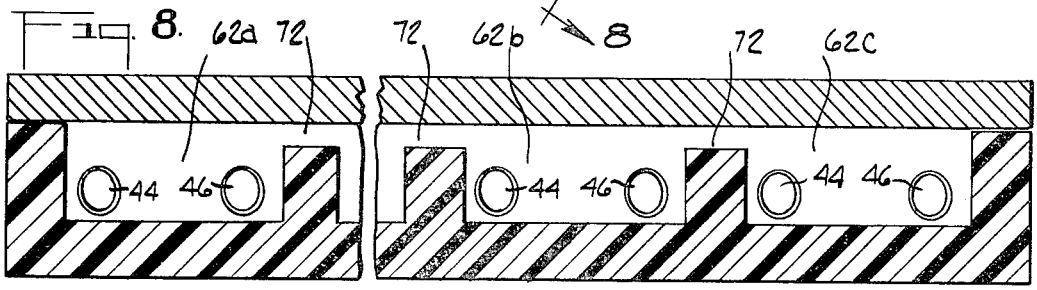
FIG. 8 is a sectional view, taken along line 8—8 of FIG. 7.

Referring now to FIG. 5 of the drawing there will be discussed in somewhat more detail the cooling water chamber 62 which is formed as a plurality of smaller chambers 62*a* to 62*c* having an inner connecting passageway 72 between each adjacent smaller chamber 62*a* to 62*c*. Each smaller chamber 62*a* to 62*c* between the opposed passageways 72 contains a cooling water inlet 44 and a cooling water outlet 46 for receiving of cooling water and for removal of warmer water obtained during the use of the coating doctor in the paper making process. By the use of the passageways 72 it can be seen that cooling water is able to flow completely through the cooling water chambers 62*a* to 62*c* and also to cool the areas in the passageway 72 thereby avoiding hotspots on the rod member 42 in that location. By providing a plurality of cooling water inlets 44 and cooling water outlets 46 in the smaller cooling water chambers 62*a* to 62*c* the Applicants' design has been able to reduce pressure drops within the cooling water system of the rod holder thereby resulting in better cooling of the rod member 42. FIGS. 5 and 8 and also in the version shown in FIG. 9, in the drawing 5 three smaller chambers 62*a* to 62*c* have been shown or described for purposes of clarity. It is within the scope of the Applicants' invention that a lesser number or a larger number may be used and the Applicant is not to be limited to using only three chambers.

By the use of the novel quick disconnect member in combination with the heat resistant material before mentioned, thermal expansion is provided for the rod holder 40 which results in no restrictions on the holder that would cause stress or warping problems along the length of the rod. By the use of the quick disconnect means, the rod (which can be removed from the top) member 42 may be changed out quickly and easily at the paper machine coating operations which negates complete removal of the entire assembly to a separate work area. The removal to a separate work area is a very difficult and time consuming disassembly procedure and requires equal amounts of time in reassembly of the rod on the holder. By the use of the Applicants' new and novel invention this entire removal procedure is shortened thereby resulting in savings of time and money.

Figure 6:
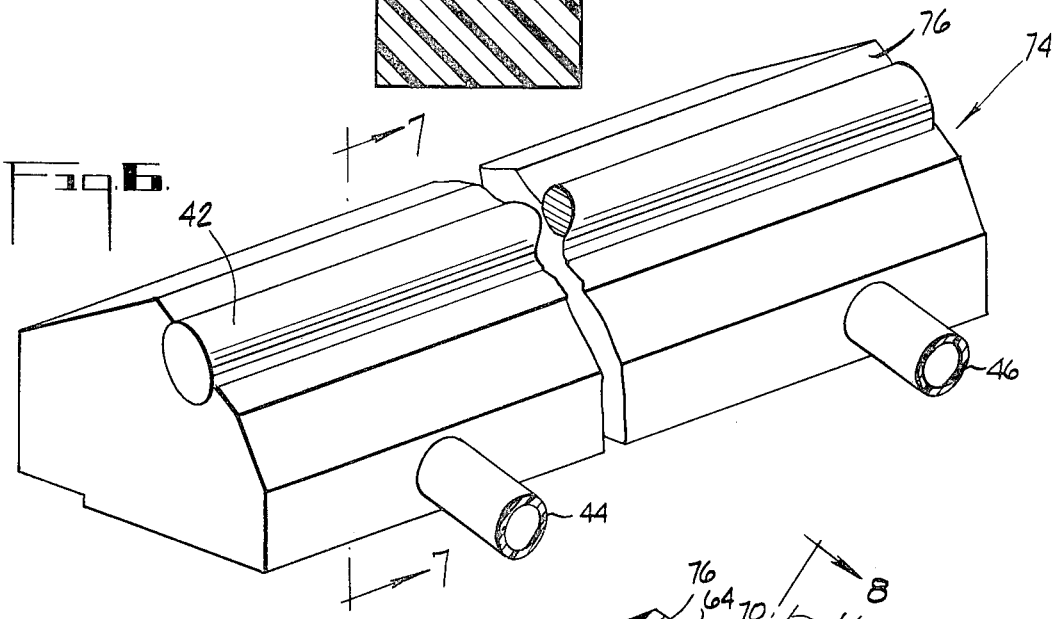
FIG. 6 is a perspective view of a variation of the Applicants' basic design.
Figure 7:
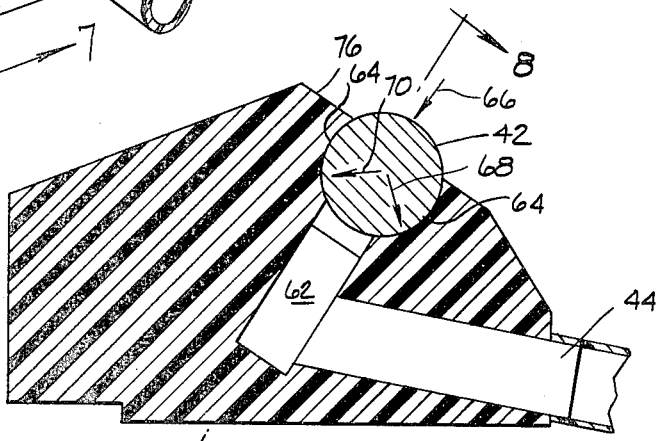
FIG. 7 is a sectional view, taken along line 7—7 of FIG. 6.

Referring now to FIGS. 6, 7 and 8 there are shown various views of a variation of the Applicants' basic design wherein the rod holder shown generally by the numeral 74 is of a different configuration with the rod member 42 being positioned along a sloping side 76 of the rod holder. By referring to FIG. 7 of the drawing there is shown a sectional view, taken along the line 7—7 of FIG. 6 showing the interior of the rod holder 74 which utilizes the cooling water chamber 62 of a design similar to the cooling water chamber shown in FIG. 4 of the drawings. The internal construction of the rod holder 72 would be similar to the rod holder 38 shown in FIG. 5 of the drawing and would comprise a series of smaller cooling water chambers 62*a* to 62*c* connected by inner connecting passageways 72 and having a plurality of cooling water inlets 44 and cooling water outlets 46 formed in each of the smaller cooling water chambers 62*a* to 62*c*. It can also be seen by referring to FIG. 7 of the drawing that whenever an external pressure shown by the arrow 66 is applied to the rod member 42, the pressure would be distributed to the wearing or sealing surfaces 64 as shown by the arrows 68 and 70.

Figure 9:
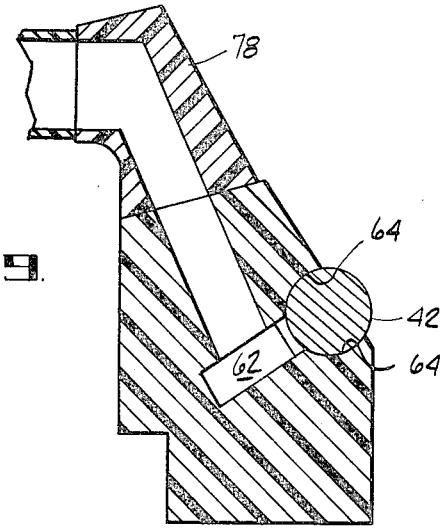
FIG. 9 is a sectional view of a further modification of the Applicants' basic design showing the basic invention used in a different configuration of a rod holder for use with a different type of paper machine.

Referring now to FIG. 9 of the drawings there is shown a further modification of the Applicants' basic design which may be used in a different configuration of a rod holder for use with a different type of paper machine. It can be seen in the FIG. 9 configuration that the rod member 42 is seated in the sealing surfaces 64 positioned on either side of the cooling water chamber 62 in a manner similar to the preferred embodiment shown in FIG. 4 of the drawing or the modification shown in FIG. 7 of the drawing. In addition, the rod holder 78 shown in FIG. 9 of the drawing would also be formed with the cooling water chamber 62 being formed as a series of smaller cooling water chambers 62*a* to 62*c* with inner connecting passages 72 as shown in FIG. 5 and FIG. 8 of the drawing of the previous modifications. When formed thusly, the modifications of FIG. 6–8 and the modification of FIG. 9 may also have applied thereto a quick disconnect assembly similar to that shown in FIG. 4 of the drawing as desired by the customer or may also be constructed without the quick disconnect assembly previously shown.

From the foregoing it can be seen that there has been provided an improved rod holder for a coating doctor system where the holder has formed therein at least one cooling water chamber which is formed beneath the rod member and forms two sealing surfaces one on each side of the water chamber that act in such a manner that a pressure exerted on the rod member downwardly during coating is transmitted downwardly and through the rod member and outwardly against the sealing surfaces to act to seal the rod member against the surfaces to prevent water leakage. The Applicants' novel rod member also contains a plurality of cooling water inlets and outlets along its length with the water chamber being formed in the preferred embodiment as a plurality of smaller chambers having inner connecting passageways connecting the smaller chambers. In addition in the preferred embodiment a quick disconnect means is provided for the rod holder. It is apparent from a review of the drawings and from a reading of the specification that many changes may be made in the various parts and arrangement of parts of the invention without departing from the spirit and scope of the invention and the preferred embodiment has been given by way of illustration only.

Having described our invention, we claim:

1. An elongated coating rod holder for a coating apparatus, comprising:

(a) an elongated cavity for receiving the coating rod, the cavity being formed in one exterior surface of the elongated holder and comprising at least two sealing surfaces therein, the sealing surfaces initiating at an exterior surface of the rod holder and terminating on the interior of the rod holder adjacent to each other and spaced apart therefrom;

(b) a cooling water chamber formed as a plurality of smaller chambers having an interconnecting passageway between each adjacent smaller chamber, the plurality of smaller chambers and interconnecting passageways being formed directly below the elongated cavity and initiating at the termination of the spaced apart sealing surfaces and terminating in the central portion of the rod holder;

(c) at least one cooling water inlet and one cooling water outlet formed in the rod holder and connecting the cooling water chamber; and (d) the elongated cavity and the elongated cooling water chamber being formed in-line with the axis of rotation of the coating rod with the sealing surfaces being formed so that a pressure exerted on the coating rod during a coating operation would be transmitted downwardly through the coating rod and outwardly to act to seal the rod member against the sealing surfaces thereby preventing leakage of water from the water chamber to the exterior of the rod holder.

2. The coating rod holder as defined in claim 1 further comprising each smaller chamber having formed therein at least one cooling water inlet and at least one cooling water outlet.

* * * * *